US011787186B2

(12) United States Patent
Shimomura et al.

(10) Patent No.: US 11,787,186 B2
(45) Date of Patent: Oct. 17, 2023

(54) PRINTING APPARATUS

(71) Applicant: Seiko Epson Corporation, Tokyo (JP)

(72) Inventors: Masaki Shimomura, Matsumoto (JP); Seiya Sato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/487,867

(22) Filed: Sep. 28, 2021

(65) Prior Publication Data

US 2022/0097382 A1 Mar. 31, 2022

(30) Foreign Application Priority Data

Sep. 29, 2020 (JP) ..... 2020-162954

(51) Int. Cl.
*B41J 2/165* (2006.01)

(52) U.S. Cl.
CPC ..... *B41J 2/16538* (2013.01); *B41J 2/16588* (2013.01)

(58) Field of Classification Search
CPC . B41J 2/16538; B41J 2/16588; B41J 2/16585
See application file for complete search history.

(56) References Cited

U.S. PATENT DOCUMENTS 5,907,335 A * 5/1999 Johnson ..... B41J 2/16552 347/33
2013/0135390 A1 5/2013 Yamamoto
2013/0215187 A1* 8/2013 Hutchison ..... B41J 2/16538 347/29
2014/0104346 A1 4/2014 Yamamoto
2015/0165774 A1 6/2015 Yamamoto
2016/0311238 A1 10/2016 Yamamoto
2017/0246870 A1 8/2017 Yamamoto
2018/0079216 A1 3/2018 Yamamoto
2019/0184708 A1 6/2019 Yamamoto
2020/0171830 A1 6/2020 Yamamoto
2021/0070051 A1 3/2021 Yamamoto

FOREIGN PATENT DOCUMENTS

JP 2017-077636 4/2017
JP 2017-159672 9/2017

* cited by examiner

*Primary Examiner* — Sharon Polk
(74) *Attorney, Agent, or Firm* — WORKMAN NYDEGGER

(57) ABSTRACT

A printer includes a line head and a wiper unit. The line head is provided to be movable between a recording position and a retreat position and performs recording on a medium by ejecting ink from an ejection surface at the recording position. The wiper unit is provided to be movable, in the Y direction, between a maintenance position at which a maintenance operation is able to be performed and a non-maintenance position away from the maintenance position. A permitting section is formed in the wiper unit. The permitting section permits a portion of the line head to move in a direction intersecting the Y direction in a state in which the wiper unit is at the non-maintenance position.

17 Claims, 9 Drawing Sheets

PRINTING APPARATUS

The present application is based on, and claims priority from JP Application Serial Number 2020-162954, filed Sep. 29, 2020, the disclosure of which is hereby incorporated by reference herein in its entirety.

BACKGROUND

1. Technical Field

The present disclosure relates to a printing apparatus.

2. Related Art

A printer according to JP-A-2017-159672 includes a head unit, a head raising/lowering mechanism that raises/lowers the head unit, a wiper unit that wipes an ejection surface of the head unit, and a wiper moving mechanism that moves the wiper unit. When the head unit performs printing, the wiper unit is at a standby position adjacent to the head unit.

In the printer described in JP-A-2017-159672, for the wiper unit to stand by at the standby position away from the head unit, the size of the apparatus main body is required to correspond to the sum of the head unit width and the wiper unit width, resulting in a possible size increase of the apparatus.

SUMMARY

To address the aforementioned problem, a printing apparatus according to the disclosure includes: a recording section that is configured to move between a recording position at which the recording section is configured to perform recording on a medium and a retreat position away from the recording position and that performs recording on the medium by ejecting a liquid from an ejection surface at the recording position; and a maintenance section that is configured to move, in a second movement direction intersecting a first movement direction, the first movement direction being a movement direction of the recording section, between a maintenance position at which the maintenance section is configured to perform a maintenance operation for the recording section and a non-maintenance position away from the maintenance position, in which at least one permitting section is formed in the maintenance section, the at least one permitting section permitting a portion of the recording section to move in the first movement direction in a state in which the maintenance section is at the non-maintenance position.

DESCRIPTION OF EXEMPLARY EMBODIMENTS

Figure 1:
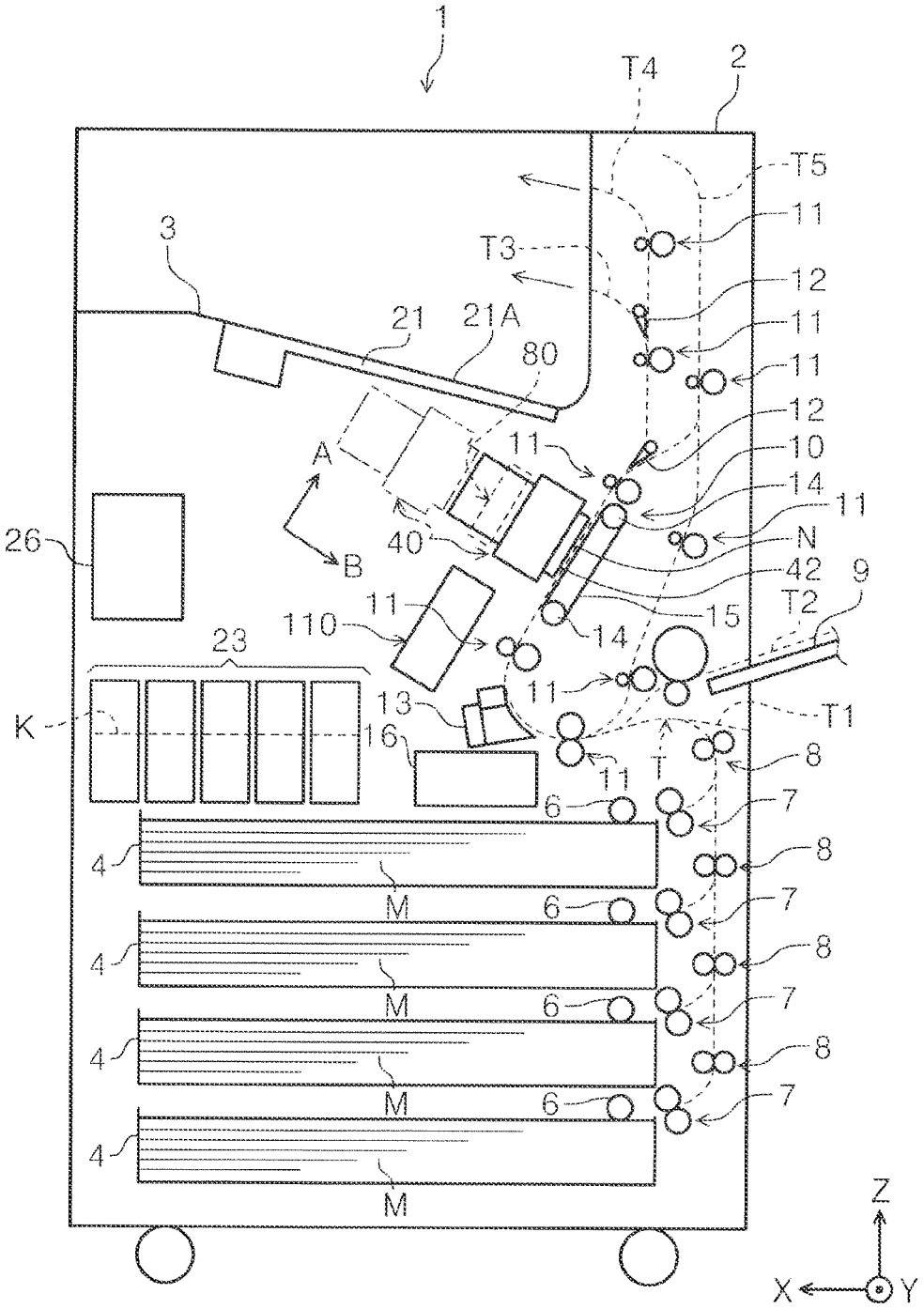
FIG. 1 illustrates a printer according to an embodiment and a transport path of a medium.

Hereinafter, the disclosure will be schematically described.

A printing apparatus according to a first aspect includes: a recording section that is configured to move between a recording position at which the recording section is configured to perform recording on a medium and a retreat position away from the recording position and that performs recording on the medium by ejecting a liquid from an ejection surface at the recording position; and a maintenance section that is configured to move, in a second movement direction intersecting a first movement direction, the first movement direction being a movement direction of the recording section, between a maintenance position at which the maintenance section is configured to perform a maintenance operation for the recording section and a non-maintenance position away from the maintenance position, in which at least one permitting section is formed in the maintenance section, the at least one permitting section permitting a portion of the recording section to move in the first movement direction in a state in which the maintenance section is at the non-maintenance position.

According to the present aspect, since at least one permitting section constituting a portion of the maintenance section permits the portion of the recording section to move in the first movement direction, the portion of the recording section and the maintenance section are able to overlap in the second movement direction. Accordingly, it is possible to suppress a size increase of the printing apparatus in the second movement direction compared with a configuration in which the portion of the recording section and the maintenance section do not overlap in the second movement direction.

According to the printing apparatus of a second aspect, in the first aspect, the permitting section is formed such that a portion of the recording section is configured to pass through the permitting section in the first movement direction.

According to the present aspect, a range in which the recording section is movable in the first movement direction is widened compared with a configuration in which movement of the recording section in the first movement direction is stopped before reaching the permitting section. Accordingly, it is possible to set a position at which the recording section performs printing on the medium to be farther from the maintenance section, thus making it possible to prevent the transported medium from interfering the maintenance section.

According to the printing apparatus of a third aspect, in the first or second aspect, the maintenance section includes a scraping section that scrapes the liquid from the ejection surface in accordance with movement in the second movement direction, and when viewed in the first movement direction, at least a portion of the scraping section overlaps the permitting section in the second movement direction.

According to the present aspect, since the width of the maintenance section in the second movement direction is reduced compared with a configuration in which the scraping section and the permitting section are arranged without overlapping in the second movement direction, it is possible to suppress a size increase of the printing apparatus in the second movement direction.

According to the printing apparatus of a fourth aspect, in the third aspect, the scraping section is a blade that divides at least a portion of the maintenance section into two regions when viewed in the first movement direction, the two regions are a region in which the liquid scraped by the blade flows and a region opposite to the region in which the liquid flows, and, of the two regions, the permitting section is formed in the region opposite to the region in which the liquid flows.

According to the present aspect, it is not necessary to form the permitting section in the region of the maintenance section, in which the liquid flows. That is, it is not necessary to reduce the region in which the liquid flows, thus making it possible to suppress a situation in which the liquid hardly flows.

According to the printing apparatus of a fifth aspect, in the fourth aspect, the blade extends in an intersecting direction, which intersects the second movement direction, when viewed in the first movement direction.

According to the present aspect, a portion of a region in which the permitting section is able to be formed is enlarged in the second movement direction compared with a configuration in which the blade extends in a direction orthogonal to the second movement direction when viewed in the first movement direction. Accordingly, an overlap margin of the recording section and the maintenance section in the second movement direction increases, thus making it possible to suppress a size increase of the printing apparatus in the second movement direction.

According to the printing apparatus of a sixth aspect, in the fourth or fifth aspect, the maintenance section includes a liquid storage section that stores the liquid scraped by the blade, and when viewed in the first movement direction, at least a portion of the liquid storage section overlaps the permitting section in the second movement direction.

According to the present aspect, it is possible to reduce the width of the maintenance section in the second movement direction compared with a configuration in which the liquid storage section and the permitting section do not overlap in the second movement direction, thus making it possible to suppress a size increase of the printing apparatus in the second movement direction.

According to the printing apparatus of a seventh aspect, in the sixth aspect, the recording section is configured to move in a direction, which intersects a vertical direction, as the first movement direction, the maintenance section is arranged in a state of being inclined in a direction orthogonal to the first movement direction when viewed in the second movement direction, the liquid storage section is located below the blade in the vertical direction, and the permitting section is located above the blade in the vertical direction.

According to the present aspect, when the liquid storage section is located below the blade, the liquid scraped by the scraping section flows to the liquid storage section due to the weight of the liquid, thus making it possible to easily collect the liquid in the liquid storage section.

Further, when the permitting section is located in a vacant region above the blade, a region of the maintenance section around the blade is effectively used, thus making it possible to suppress a size increase of the maintenance section.

According to the printing apparatus of an eighth aspect, in any of the fourth to seventh aspects, the maintenance section includes a blade holding section that holds the blade and a support section that is configured to move in the second movement direction and supports the blade holding section in the first movement direction, and the permitting section includes a first permitting section formed in the support section and a second permitting section that is formed in the blade holding section and recessed in the second movement direction toward the blade more than the first permitting section.

According to the present aspect, the second permitting section is recessed toward the blade more than the first permitting section compared with a configuration in which the second permitting section and the first permitting section have the same size, thus making it possible to reduce the volume and mass of the blade holding section. As a result, the blade holding section is able to be easily removed, for example, to exchange the blade by removing the blade holding section from the maintenance section.

A printer 1 of an embodiment, which is an example of the printing apparatus according to the disclosure, will be specifically described below.

As illustrated in FIG. 1, the printer 1 is configured as an ink jet apparatus that performs recording on a medium M such as recording paper by ejecting ink K, which is an example of the liquid. Note that the X-Y-Z coordinate system illustrated in each drawing is an orthogonal coordinate system.

The X direction is an apparatus width direction when viewed from an operator of the printer 1 and is the horizontal direction. In the X direction, a leftward direction is the +X direction, and a rightward direction is the −X direction.

The Y direction is a width direction of a medium M, which intersects a transport direction of the medium M, an apparatus depth direction, and the horizontal direction. The Y direction intersects both the direction A and the direction B described later. In the Y direction, a frontward direction is the +Y direction, and a rearward direction is the −Y direction. Further, the Y direction is an example of a movement direction of a wiper unit 80 described later and intersects both the Z direction and the direction A described later.

The Z direction is an apparatus height direction and, for example, the vertical direction. In the Z direction, an upward direction is the +Z direction, and a downward direction is the −Z direction.

In the printer 1, the medium M is transported on a transport path T indicated by the broken line. The A-B coordinate system indicated in the X-Z plane is an orthogonal coordinate system.

The direction A is the transport direction of the medium M in a region of the transport path T, which faces a line head 40 described later. In the direction A, an upstream direction is the direction −A, and a downstream direction is the direction +A. Moreover, the direction A is an example of the intersecting direction, which intersects the Z direction. In the present embodiment, the direction A is a direction inclined such that the position of the transport path T in the direction +A is located in the +Z direction with respect to the position thereof in the direction −A. Specifically, the direction A is inclined relative to the Z direction at an angle in a range of 20° to 40°, more specifically, inclined at substantially 30°. In other words, the direction A is inclined relative to the X direction at substantially 60°.

The direction B is an example of a direction orthogonal to an ejection surface 42 described later and is a direction in which the line head 40 described later reciprocates with respect to a transport unit 10 described later. The direction B is an example of the first movement direction, which is a movement direction of the line head 40. Further, the direction B is a direction intersecting the vertical direction. In the direction B, a direction in which the line head 40 approaches the transport unit 10 is the direction +B, and a direction in which the line head unit 40 is away from the transport unit 10 is the direction −B. The direction B is a direction inclined such that a position in the direction −B is located in the +Z direction with respect to a position in the direction +B.

The printer 1 includes a housing 2, which is an example of an apparatus main body. A discharge section 3 having a space to which the recorded medium M is discharged is formed in the +Z direction with respect to the center of the housing 2 in the Z direction. Moreover, a plurality of media cassettes 4 are provided in the housing 2.

Media M are stored in the plurality of media cassettes 4. The medium M stored in the media cassettes 4 is transported on the transport path T by a pick-up roller 6 and pairs of transport rollers 7 and 8. A transport path T1 on which the medium M is transported from an external apparatus and a transport path T2 on which the medium M is transported from a manual tray 9 provided in the housing 2 merge on the transport path T.

The transport unit 10, a plurality of pairs of transport rollers 11 for transporting the medium M, a plurality of flaps 12 for switching a path on which the medium M is transported, and a medium-width sensor 13 for detecting a width of the medium M in the Y direction are arranged on the transport path T.

The transport unit 10 includes two pulleys 14, an endless transport belt 15 wound around the two pulleys 14, and a motor (not illustrated) that drives one of the pulleys 14. The medium M is transported in the direction +A at a position facing the line head 40 described later while the medium M is sucked on a belt surface of the transport belt 15.

The transport path T extends from the medium-width sensor 13 in the direction +A. A transport path T3 and a transport path T4 toward the discharge section 3 and an inverting path T5 on which the front and back of the medium M are inverted are provided downstream of the transport unit 10 on the transport path T. A discharge tray 21 is provided in a bottom portion of the discharge section 3. The discharge tray 21 has a mounting surface 21A on which the medium M is mounted.

An ink container 23 that stores the ink K, a waste-liquid accumulation section 16 that accumulates waste liquid of the ink K, and a control section 26 that controls operation of the respective sections of the printer 1 are provided in the housing 2. The ink container 23 supplies the ink K to the line head 40 via a tube (not illustrated). The waste-liquid accumulation section 16 accumulates waste liquid of the ink K collected by the wiper unit 80 or a capping unit 110 described later.

The control section 26 includes a central processing unit (CPU), read-only memory (ROM), random access memory (RAM), and storage, which are not illustrated, and controls transportation of the medium M in the printer 1 and operation of the respective sections including the line head 40 and the wiper unit 80.

Figure 2:
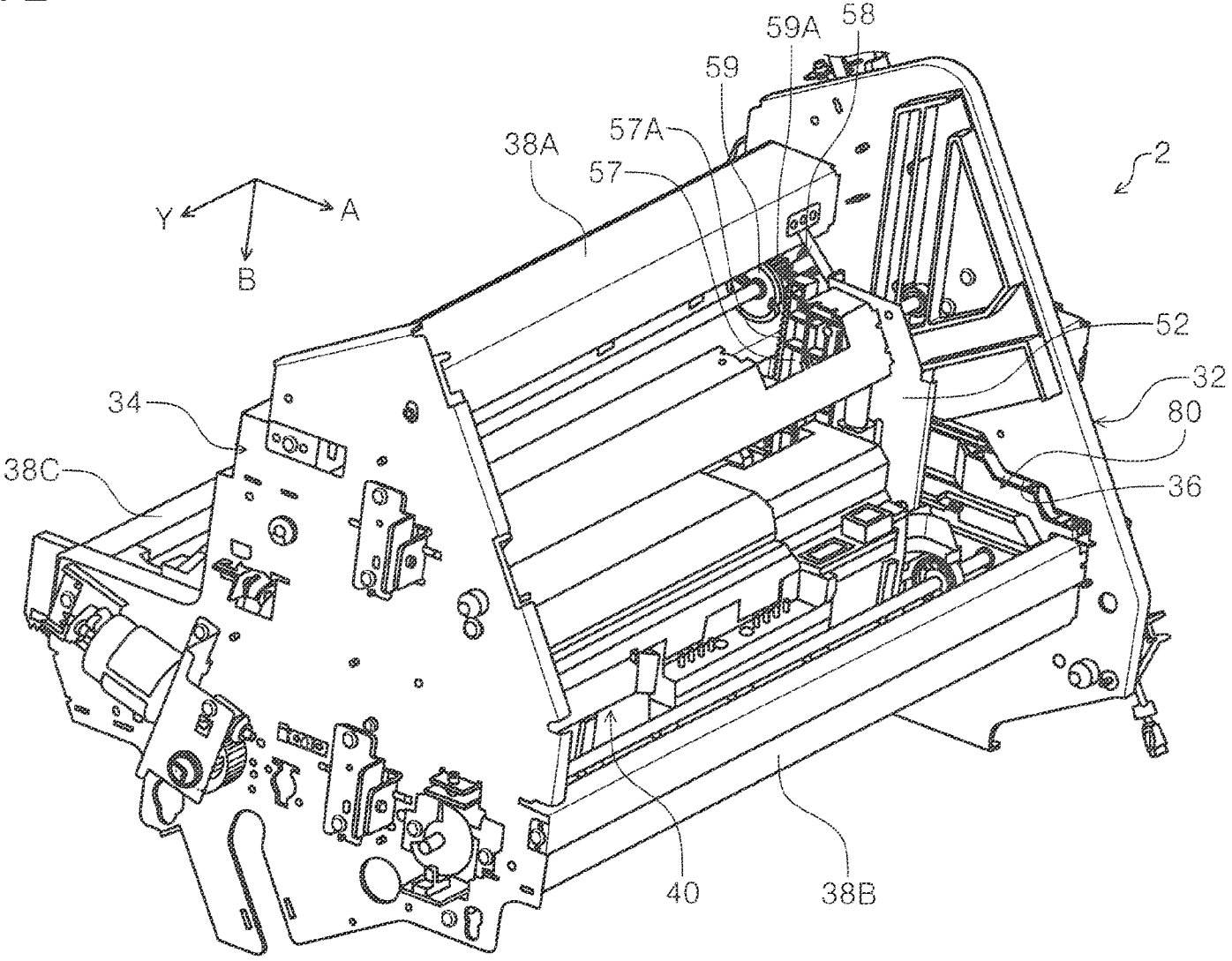
FIG. 2 is a perspective view illustrating a line head and a peripheral portion thereof in the printer according to the embodiment.

As illustrated in FIG. 2, for example, a side frame 32 and a side frame 34 are provided in the housing 2 as a pair of side walls. The side frame 32 and the side frame 34 are arranged opposite to each other with a gap therebetween in the Y direction.

The side frame 32 is formed of, for example, sheet metal and stands upright in the A-B plane of the housing 2. The side frame 32 is arranged in the −Y direction with respect to the center of the housing 2 in the Y direction. A through hole 36 passes through the side frame 32 in the Y direction. The size and shape of the through hole 36 are set so as to enable the wiper unit 80 described later to pass through the through hole 36 in the Y direction.

The side frame 34 is formed of, for example, sheet metal and stands upright in the A-B plane of the housing 2. The side frame 34 is arranged in the +Y direction with respect to the center of the housing 2 in the Y direction. No through hole is formed in the side frame 34. The side frame 32 and the side frame 34 are coupled by lateral frames 38A, 38B, and 38C. The line head 40 is arranged in a space between the side frame 32 and the side frame 34.

As illustrated in FIG. 1, the printer 1 includes the line head 40 that performs recording on the medium M and the wiper unit 80 that cleans nozzles N of the line head 40, which will be described later. The printer 1 further includes a head moving unit 58 (FIG. 2) that moves the line head 40 in the direction B and the capping unit 110 that covers the nozzles N.

A driving mechanism (not illustrated) including a rack and a pinion enables the capping unit 110 to be reciprocated in the direction A. When the line head 40 moves to a recording position described later, the capping unit 110 retreats in the direction −A with respect to the line head 40. Further, when the line head 40 is at a retreat position described later, the capping unit 110 moves in the direction +A so as to cover a plurality of nozzles N and collects the ink K ejected from the plurality of nozzles N. The ink K collected by the capping unit 110 is transferred to the waste-liquid accumulation section 16.

Figure 3:
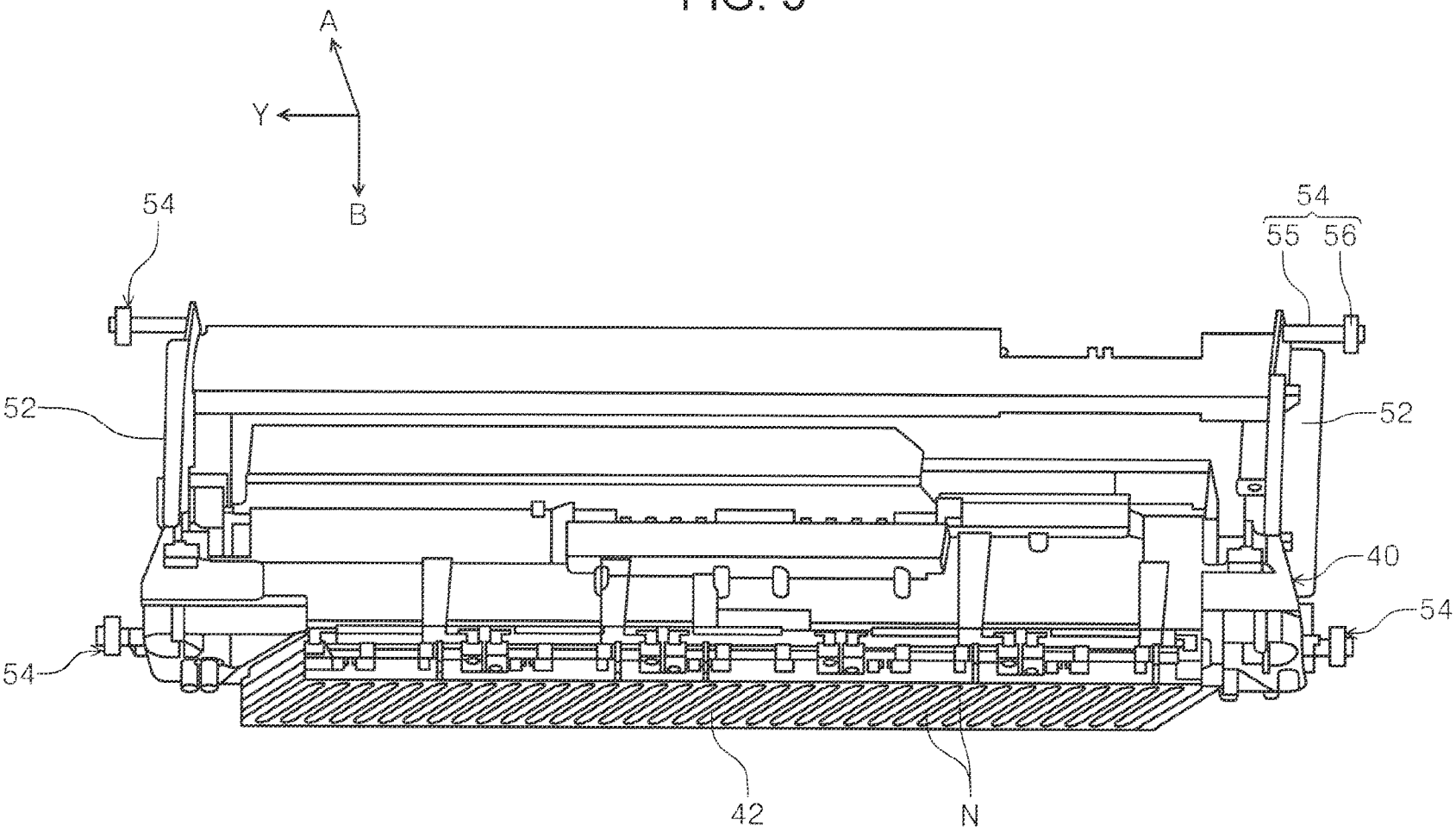
FIG. 3 is a perspective view of the line head of the printer according to the embodiment.

As illustrated in FIG. 3, the line head 40 is an example of the recording section and includes the ejection surface 42. The ejection surface 42 is arranged in, for example, the A-Y plane. The ejection surface 42 has the plurality of nozzles N for ejecting the ink K. The plurality of nozzles N are examples of a plurality of ejection ports and extend over the entire region of the medium M in the Y direction. The line head 40 performs recording on the medium M by ejecting the ink K from the plurality of nozzles N on the ejection surface 42 at the recording position described later.

In this manner, the line head 40 is configured as an ink ejecting head capable of performing recording on the entire region of the medium M in the Y direction without the medium M moving in the Y direction. However, the ink ejecting head is not limited to being configured as the line head 40 and may be configured as a serial type in which ink is ejected while the ink ejecting head mounted on a carriage moves in the Y direction of the medium M.

The line head 40 extends in the Y direction. A single support frame 52 is attached to each end of the line head 40 in the Y direction. The support frame 52 is configured as a side plate in the A-B plane and extends from the line head 40 in the direction −B. Note that the line head 40 and the support frames 52 are arranged between the side frame 32 and the side frame 34 (FIG. 2). That is, the line head 40 is movable in the direction B between the side frame 32 and the side frame 34.

Each of the two support frames 52 includes two protrusions 54 that protrude outward in the Y direction. The two protrusions 54 are each an example of a portion of the line head 40 and are arranged in the corresponding support frame 52 with a gap therebetween in the direction B.

Each of the protrusions 54 includes a shaft section 55 that extends from the corresponding support frame 52 outward in the Y direction and a bearing 56 rotatably provided in a tip end of the shaft section 55. The shaft section 55 has a columnar shape whose central axis extends in the Y direction. The bearing 56 is rotatable about the central axis of the shaft section 55. In the support frame 52, a distance corresponding to a gap between the bearing 56 on the direction −B side and the bearing 56 on the direction +B side is longer than a distance corresponding to a length of the through hole 36 (FIG. 2) in the direction B.

As illustrated in FIG. 2, the support frame 52 includes a rack 57. The rack 57 is a plate member having a thickness direction in the Y direction and extends in the direction B. A plurality of tooth sections 57A arrayed in the direction B are formed on the direction −A end of the rack.

The head moving unit 58 is an example of the moving mechanism that moves the line head 40. The head moving unit 58 is configured to enable the line head 40 to move between the recording position and the retreat position such that the line head 40 reciprocates in the direction B with respect to the transport belt 15 (FIG. 1). In other words, the head moving unit 58 moves the line head 40 in the direction B such that the movement direction of the line head 40 intersects both the vertical direction and the horizontal direction. The head moving unit 58 includes a pinion 59 and a motor (not illustrated) for rotating the pinion 59, and driving of the head moving unit 58 is controlled by the control section 26 (FIG. 1).

A tooth section 59A formed on the outer peripheral surface of the pinion 59 engages a tooth section 57A. Accordingly, when the pinion 59 rotates in the positive direction, the line head 40 moves to the recording position, and when the pinion 59 rotates in the opposite direction, the line head 40 moves to the retreat position.

The recording position of the line head 40 is a stop position of the line head 40 when the line head 40 is able to record information on the medium M. Note that, since the recording position of the line head 40 is able to be adjusted in the direction B by an adjusting unit (not illustrated), one or more recording positions exist.

The retreat position of the line head 40 is a stop position of the line head 40 when the line head 40 is away from the recording position in the direction −B. The retreat position of the line head 40 includes a standby position at which the line head 40 is able to move to the recording position again and a replacement position at which the line head 40 is able to be removed from the housing 2.

Figure 4:
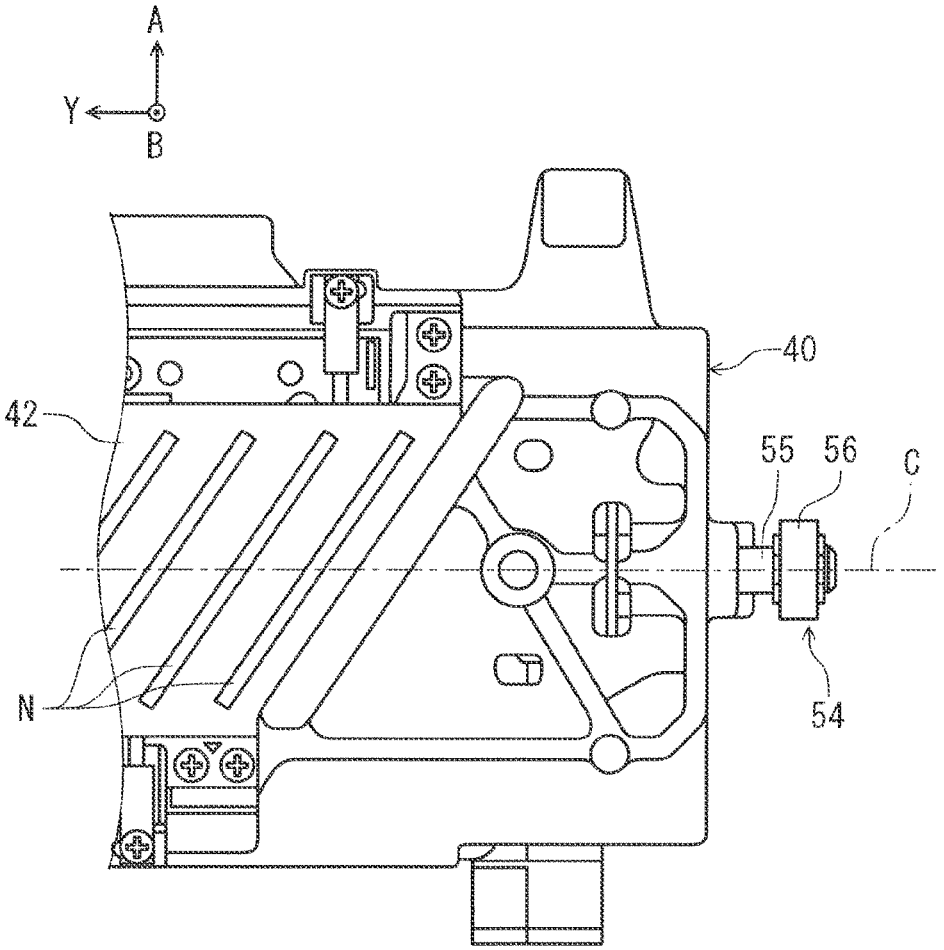
FIG. 4 is a bottom view of a portion of the line head of the printer according to the embodiment.

As illustrated in FIG. 4, the one-dot chain line that extends in the Y direction so as to pass through the center of the ejection surface 42 in the direction A when viewed in the direction B is center line C. The shaft section 55 and the bearing 56 are positioned on center line C when viewed in the direction B. In other words, center line C is parallel to the rotational axis of the bearing 56.

Figure 5:
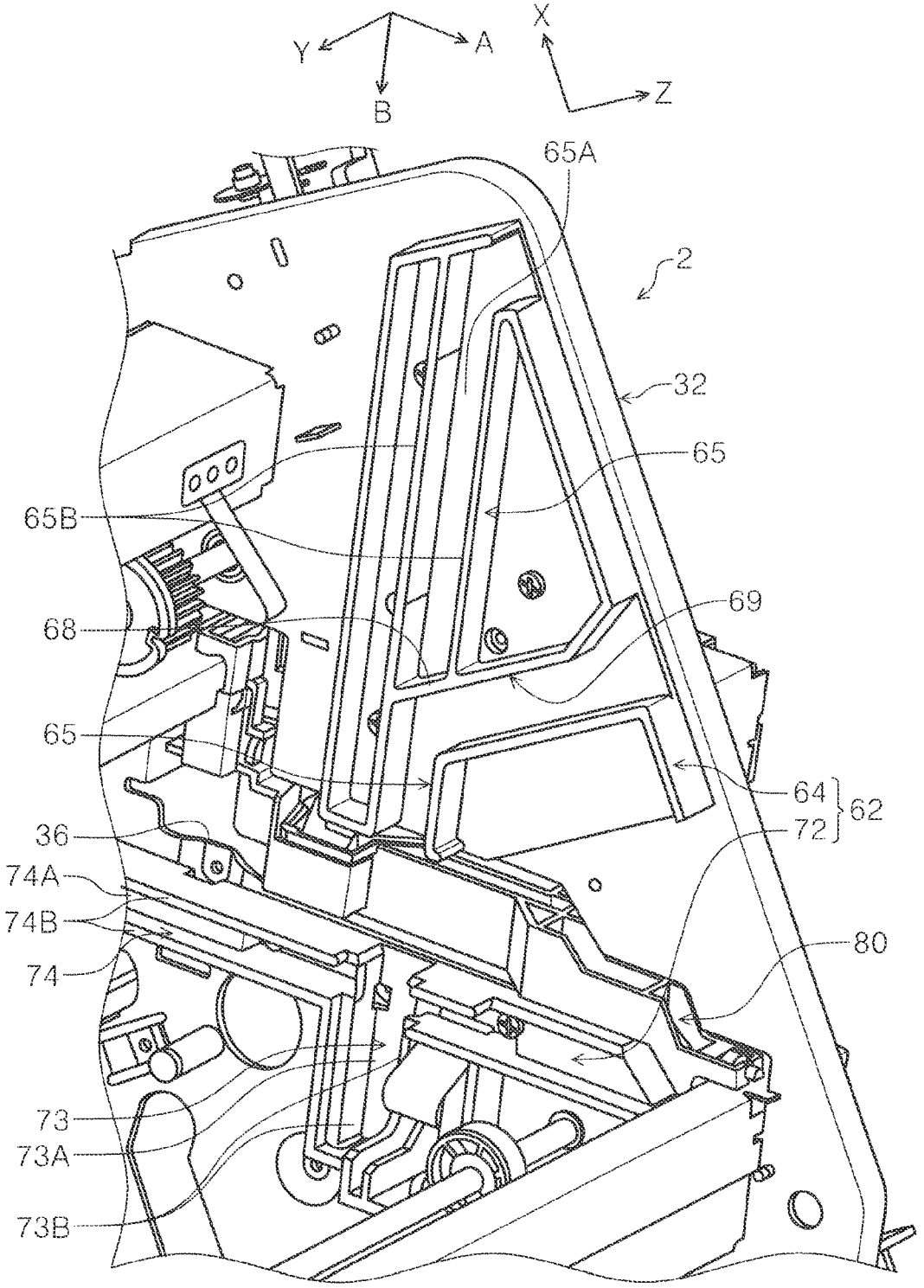
FIG. 5 is a perspective view of a guide member for guiding the line head of the printer according to the embodiment.

As illustrated in FIG. 5, a guide member 62, which is an example of a guiding member for guiding the line head 40 (FIG. 1) in the direction B, is provided in the side frame 32. The guide member 62 is divided by the through hole 36 into a portion on the direction −B side and a portion on the direction +B side. Specifically, the guide member 62 is constituted by a first guide member 64 and a second guide member 72.

In the side frame 32, the first guide member 64 is provided in the portion on the direction −B side with respect to the through hole 36. The first guide member 64 includes a guide rail 65, which is an example of a longitudinal groove section, and a guide rail 69 joined to the guide rail 65.

The guide rail 65 is open in the +Y direction toward the line head 40 and has a U-shaped cross section when viewed in the direction B. The guide rail 65 extends substantially linearly in the direction B as a guiding direction. The guide rail 65 guides the bearing 56 (FIG. 3) in the direction B.

Specifically, the guide rail 65 has a bottom wall 65A arranged in the A-B plane and a pair of side walls 65B that stand upright in the +Y direction from respective ends of the bottom wall 65A in the direction A. The direction −B end of the guide rail 65 is open in the +Z direction. The direction +B end of the guide rail 65 is located in an edge of the through hole 36 and is open toward the through hole 36. A regulating section 68 is formed between the center and the end of the guide rail 65 in the direction +B. The regulating section 68 is a plate section in the Y-Z plane and regulates movement of the bearing 56, which is located in the direction −B, in the direction +B with respect to the regulating section 68.

In the side wall 65B on the direction +A side, a portion located in the direction +B with respect to the regulating section 68 is cut out. The cut-out portion of the side wall 65B is coupled to one end of the guide rail 69.

The guide rail 69 has a U-shaped cross section open in the +Y direction and has a width similar to that of the guide rail 65. The guide rail 69 extends in the +Z direction from the portion in which the guide rail 69 and the guide rail 65 are joined. Here, when two bearings 56 in the −Y direction are guided by the guide rails 65 and 69, the line head 40 is able to separate from the first guide member 64 in the +Z direction.

The second guide member 72 is provided in the portion of the side frame 32 on the direction +B side with respect to the through hole 36. The second guide member 72 includes a guide rail 73, which is an example of the longitudinal groove section, and a guide rail 74, which is an example of a lateral groove section.

The guide rail 73 extends in the direction B. The guide rail 74 extends in the direction A. That is, the guide rail 73 is orthogonal to the guide rail 74. Specifically, the guide rail 73 has a bottom wall 73A arranged in the A-B plane and a pair of side walls 73B that stand upright in the +Y direction from respective ends of the bottom wall 73A in the direction A. The direction −B end of the guide rail 73 is open in the direction −B. The direction +B end of the guide rail 73 is closed. Note that the width of the guide rail 73 in the direction A is substantially the same as the width of the guide rail 65 in the direction A.

The guide rail 74 has a U-shaped cross section open in the +Y direction toward the capping unit 110 (FIG. 1) and extends linearly in the direction A as the guiding direction. The guide rail 74 is divided at a portion in which the guide rail 74 intersects the guide rail 73. Specifically, the guide rail 74 has a bottom wall 74A arranged in the A-B plane and a pair of side walls 74B that stand upright in the +Y direction from respective ends of the bottom wall 74A in the direction B.

Note that the bottom wall 65A and the bottom wall 73A are at substantially the same position in the +Y direction. This facilitates entry of the bearing 56 when the bearing 56 (FIG. 3) moves from one of the guide rail 65 and the guide rail 73 to the other with the through hole 36 therebetween.

The side frame 34 (FIG. 2) includes a guide member (not illustrated). Although the guide member has no through hole 36, the guide member and the guide member 62 are formed to be substantially symmetrical with respect to a virtual plane (not illustrated) that passes through the center of the housing 2 in the Y direction and that is orthogonal to the Y direction. Thus, illustration and description of the guide member of the side frame 34 will be omitted.

Figure 6:
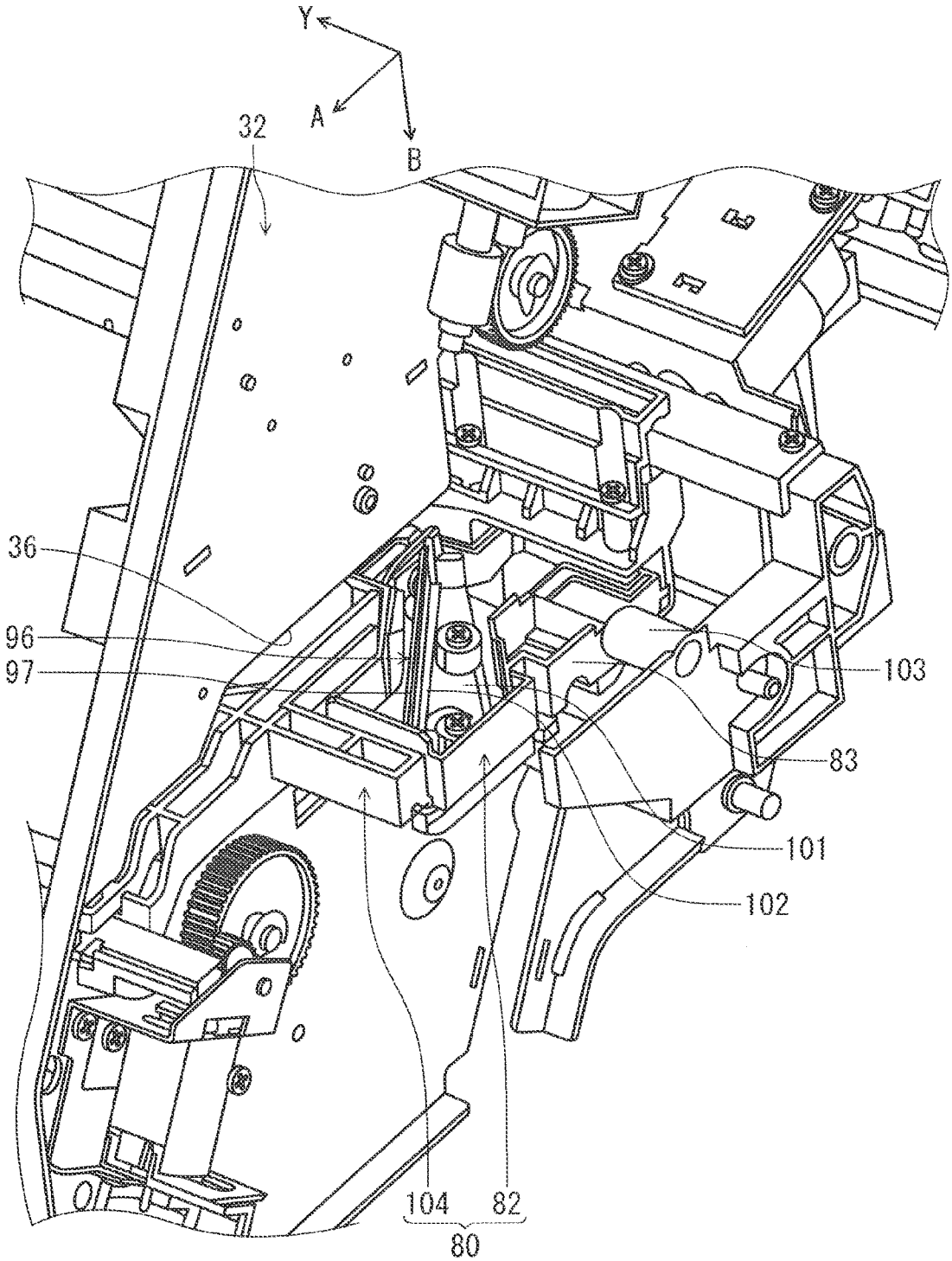
FIG. 6 is a perspective view illustrating a wiper unit arranged at a non-maintenance position in the printer according to the embodiment.

As illustrated in FIG. 6, the wiper unit 80 is an example of the maintenance section and functions as a cleaning section for cleaning the ejection surface 42 (FIG. 3). The wiper unit 80 is able to be reciprocated in the Y direction by a driving unit (not illustrated). Examples of the driving unit for driving the wiper unit 80 include a timing belt and a pulley (not illustrated). The Y direction is an example of the second movement direction intersecting the direction B.

The wiper unit 80 is provided to be movable, in the Y direction, between a maintenance position at which a maintenance operation for the line head 40 (FIG. 3) is able to be performed and a non-maintenance position away from the maintenance position.

The wiper unit 80 is arranged in a state of being inclined in the direction A orthogonal to the direction B when viewed in the Y direction.

When the line head 40 (FIG. 3) moves to the recording position, the wiper unit 80 retreats in the −Y direction with respect to the line head 40. While the line head 40 is at the retreat position, the wiper head 80 temporarily moves in the +Y direction and then cleans the ejection surface 42 (FIG. 3) while moving in the −Y direction. In other words, the wiper unit 80 scrapes off the ink K attached to the ejection surface 42. Specifically, the wiper unit 80 includes a blade unit 82 and a wiper carriage 104.

The blade unit 82 is an example of the blade holding section and holds a main blade 97 described later. Specifically, the blade unit 82 includes a unit main body 83, a blade section 96, a base frame 101, an attachment frame 102, and a cover member (not illustrated).

Figure 7:
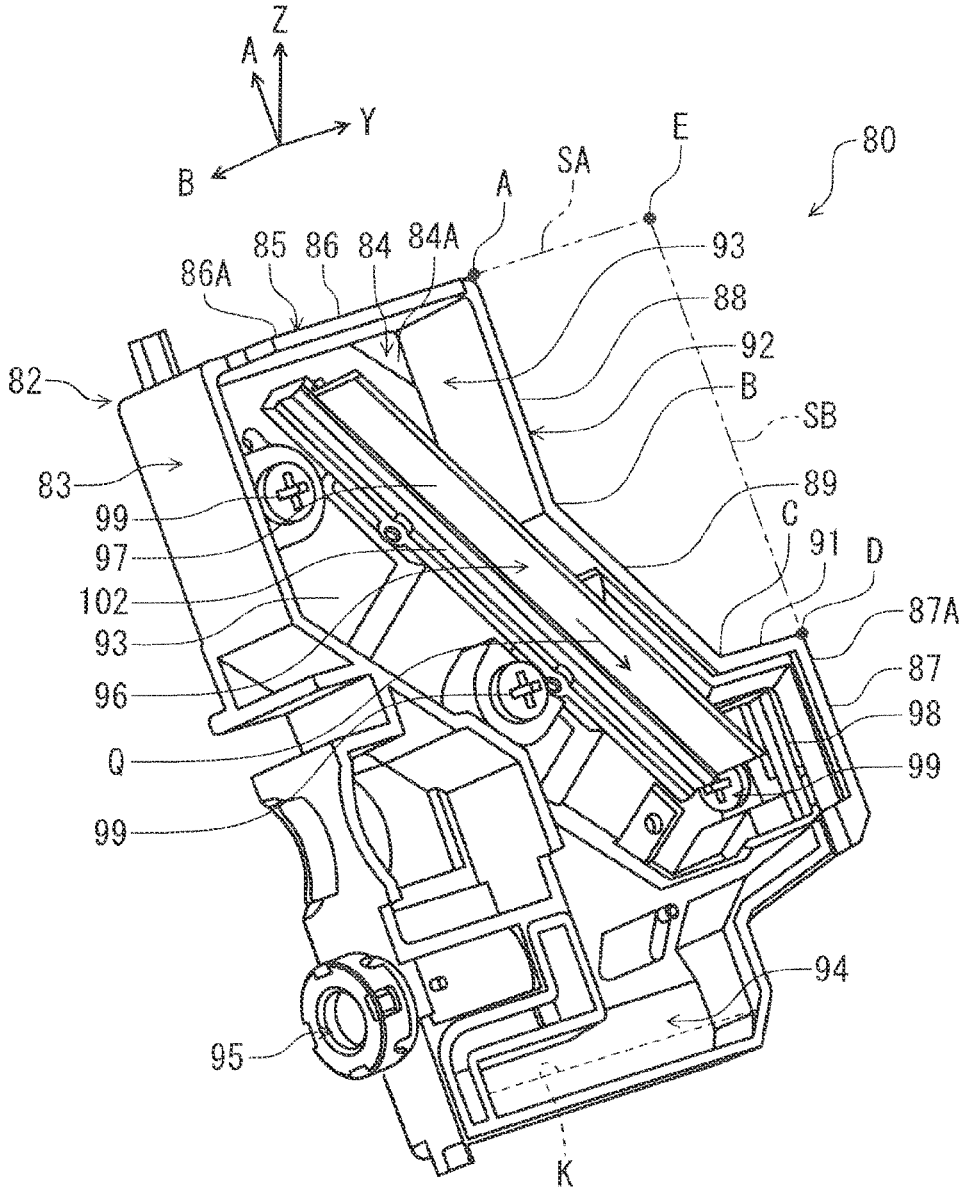
FIG. 7 is a perspective view of a blade unit of the printer according to the embodiment.

As illustrated in FIG. 7, the unit main body 83 has a box shape open in the direction −B. Specifically, the unit main body 83 includes a bottom wall 84 and a peripheral wall 85.

The bottom wall 84 has a plate shape having a predetermined thickness in the direction B. The bottom wall 84 has a bottom surface 84A which is a surface of the bottom wall 84 in the direction −B and which extends in the A-Y plane.

The peripheral wall 85 stands upright in the direction −B from an outer peripheral edge of the bottom wall 84. The peripheral wall 85 is constituted by a plurality of walls including, for example, a lateral side wall 86, a longitudinal side wall 87, a longitudinal wall 88, an inclined wall 89, and a lateral wall 91.

The lateral side wall 86 is located in the direction +A end of the peripheral wall 85 and extends in the Y direction in the B-Y plane. A virtual plane SA obtained by extending an outer surface 86A of the lateral side wall 86 in the +Y direction is indicated by two-dot chain line SA. Moreover, in the A-Y plane, a position corresponding to the +Y direction end of the lateral side wall 86 is indicated by point A.

The longitudinal side wall 87 is located in the +Y direction end of the peripheral wall 85 and extends in the direction A in the A-B plane. A virtual plane SB obtained by extending an outer surface 87A of the longitudinal side wall 87 in the direction +A is indicated by two-dot chain line SB. An intersection of two-dot chain line SA and two-dot chain line SB is indicated by point E. Moreover, in the A-Y plane, a position corresponding to the direction +A end of the longitudinal side wall 87 is indicated by point D.

The longitudinal wall 88 extends in the direction −A from the +Y direction end of the lateral side wall 86. The longitudinal wall 88 extends in the A-B plane.

The inclined wall 89 extends from the direction −A end of the longitudinal wall 88 in a direction intersecting the direction A. Specifically, the inclined wall 89 is inclined such that the +Y direction end is located in the direction −A with respect to the −Y direction end. A position at which the longitudinal wall 88 and the inclined wall 89 cross in the A-Y plane is indicated by point B.

The lateral wall 91 extends in the +Y direction from the +Y direction end of the inclined wall 89 to the direction +A end of the longitudinal side wall 87. The lateral wall 91 extends in the A-B plane. A position at which the inclined wall 89 and the lateral wall 91 cross in the A-Y plane is indicted by point C.

When the unit main body 83 is viewed in the direction B, a portion thereof located in the direction A and the Y direction with respect to the center of the unit main body 83 in the direction A has an external shape obtained by removing pentagon ABCDE from a quadrangle having sides extending in the direction A and sides extending in the Y direction. A portion of the unit main body 83 excluding a portion corresponding to pentagon ABCDE is a second permitting section 92. That is, the second permitting section 92 is formed in the wiper unit 80.

The second permitting section 92 is a portion recessed in the −Y direction and the direction −A from point E in the main body unit 83. In other words, the second permitting section 92 is a portion formed in the blade unit 82 and recessed in the Y direction toward the main blade 97 more than a first permitting section 107 (FIG. 9) described later.

Specifically, the second permitting section 92 is formed by the longitudinal wall 88, the inclined wall 89, and the lateral wall 91. The second permitting section 92 is a portion that permits passage of the protrusion 54 (FIG. 3) in the direction B in a state in which the wiper unit 80 (FIG. 6) is at the non-maintenance position. Further, the second permitting section 92 is located in the +Z direction with respect to the main blade 97 described later, that is, above the main blade 97 in the Z direction.

The unit main body 83 includes a blade attachment section 93, an ink storage section 94, and a receiving section 95.

The blade attachment section 93 is a portion demarcated by the peripheral wall 85 and is a chamber from the central portion of the unit main body 83 in the direction A to the direction +A end thereof.

The ink storage section 94 is an example of the liquid storage section. The liquid storage section 94 is a portion demarcated by the peripheral wall 85 and is a chamber in the direction −A with respect to the central portion of the unit main body 83 in the direction A. Further, the ink storage section 94 is a space demarcated by the unit main body 83 and a cover member (not illustrated) and communicates with the interior of the blade attachment section 93.

The ink K scraped by the main blade 97 described later is stored in the ink storage section 94. The ink storage section 94 is located in the −Z direction with respect to the main blade 97 described later, that is, below the main blade 97 in the Z direction.

The receiving section 95 is formed in a portion of the unit main body 83, which is in the direction −A with respect to a portion of the ink storage section 94. A wiper needle 103 (FIG. 6) for sucking the ink K is inserted into the receiving section 95 in the +Y direction. When the wiper needle 103 performs the sucking operation, the ink K in the ink storage section 94 is discharged to the outside of the unit main body 83.

The blade section 96 is an example of the scraping section and includes the main blade 97 and a sub blade 98.

The main blade 97 is an example of the blade. A direction in which the main blade 97 extends when viewed in the direction B is a direction Q. The direction Q is a direction intersecting both the Y direction and the direction A. The main blade 97 is made from rubber formed into a plate shape having a predetermined thickness in a direction orthogonal to the direction Q. Further, the main blade 97 is inclined such that, for example, the −Y direction end is located in the direction +A with respect to the +Y direction end. Accordingly, the main blade 97 divides the blade attachment section 93, which is a portion of the wiper unit 80, into two regions S1 and S2 (FIG. 9) described later when viewed in the direction B.

The main blade 97 comes into contact with the ejection surface 42 (FIG. 3) to thereby scrape the ink K while the main blade 97 elastically deforms. That is, the main blade 97 scrapes the ink K from the ejection surface 42 in accordance with movement of the wiper unit 80 in the Y direction.

Figure 9:
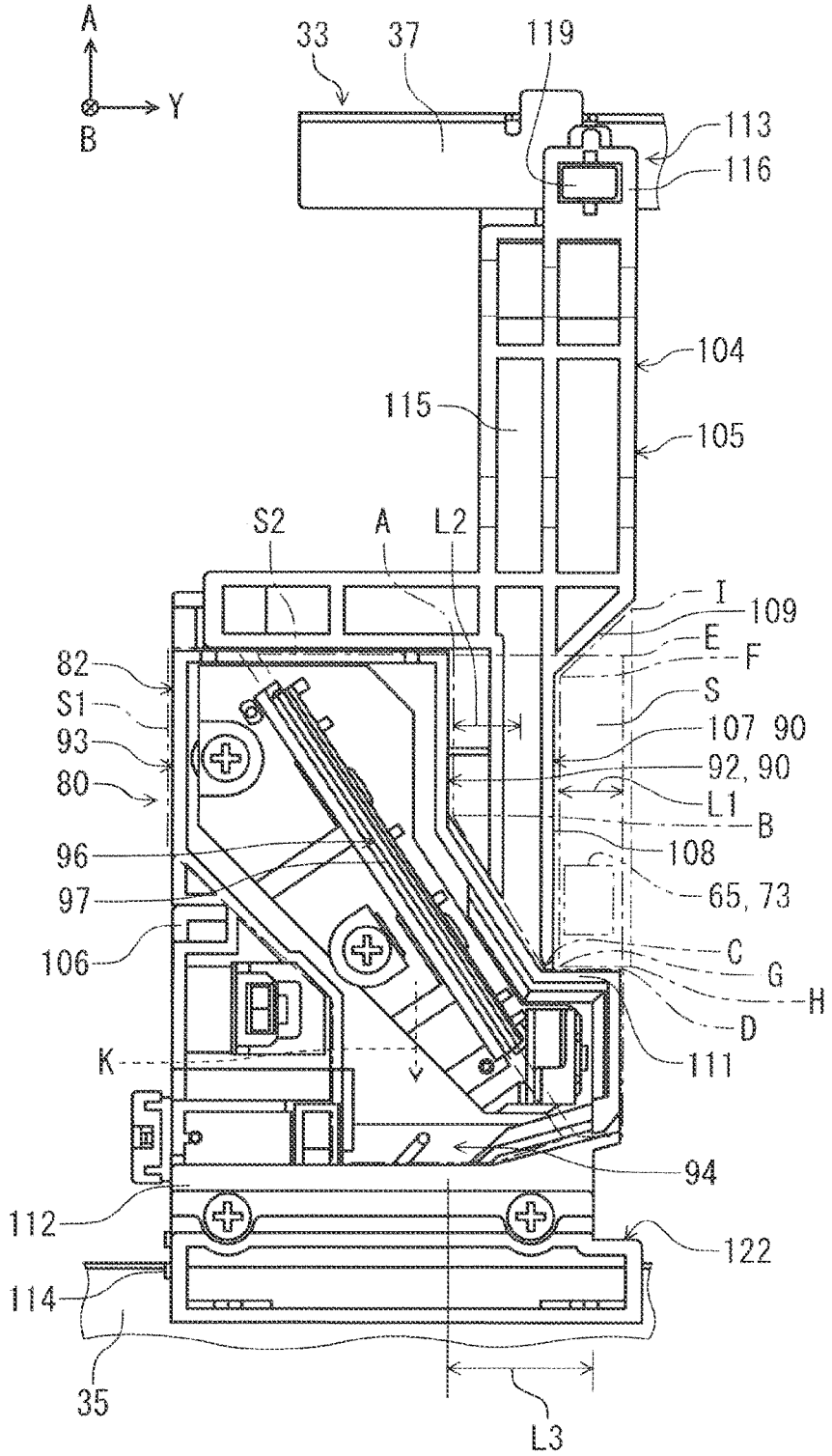
FIG. 9 is a plan view of the wiper unit, which is viewed in the direction +B, of the printer according to the embodiment.

As illustrated in FIG. 9, the blade attachment section 93 is divided by the main blade 97 into the region S1 and the region S2.

The region S1 is located in the direction −A and the −Y direction with respect to the main blade 97. The region S1 is a region in which the ink K scraped by the main blade 97 flows.

The region S2 is at a position in the direction +A and the +Y direction with respect to the main blade 97. The region S2 is a region opposite to the region S1 with the main blade 97 therebetween. Here, the second permitting section 92 is formed in the region S2.

As illustrated in FIG. 7, the sub blade 98 is arranged in the +Y direction with respect to the +Y direction end of the main blade 97. Moreover, the sub blade 98 is made from rubber formed into a plate shape having a predetermined thickness in the Y direction when viewed in the direction B. The sub blade 98 extends in, for example, the direction A. The sub blade 98 comes into contact with the +Y direction side surface of the line head 40 (FIG. 3) to thereby scrape the ink K attached to the +Y direction side surface of the line head 40.

The base frame 101 is fastened to the blade attachment section 93 with a screw 99. The attachment frame 102 is attached to the base frame 101 while the lower end of the main blade 97 in the direction +B is held between the base frame 101 and the attachment frame 102. Accordingly, the main blade 97 is held. Similarly, the sub blade 98 is also fastened to the base frame 101 with a screw 99. Note that the main blade 97 and the sub blade 98 protrude in the direction −B more than the direction −B end surface of the unit main body 83.

Figure 8:
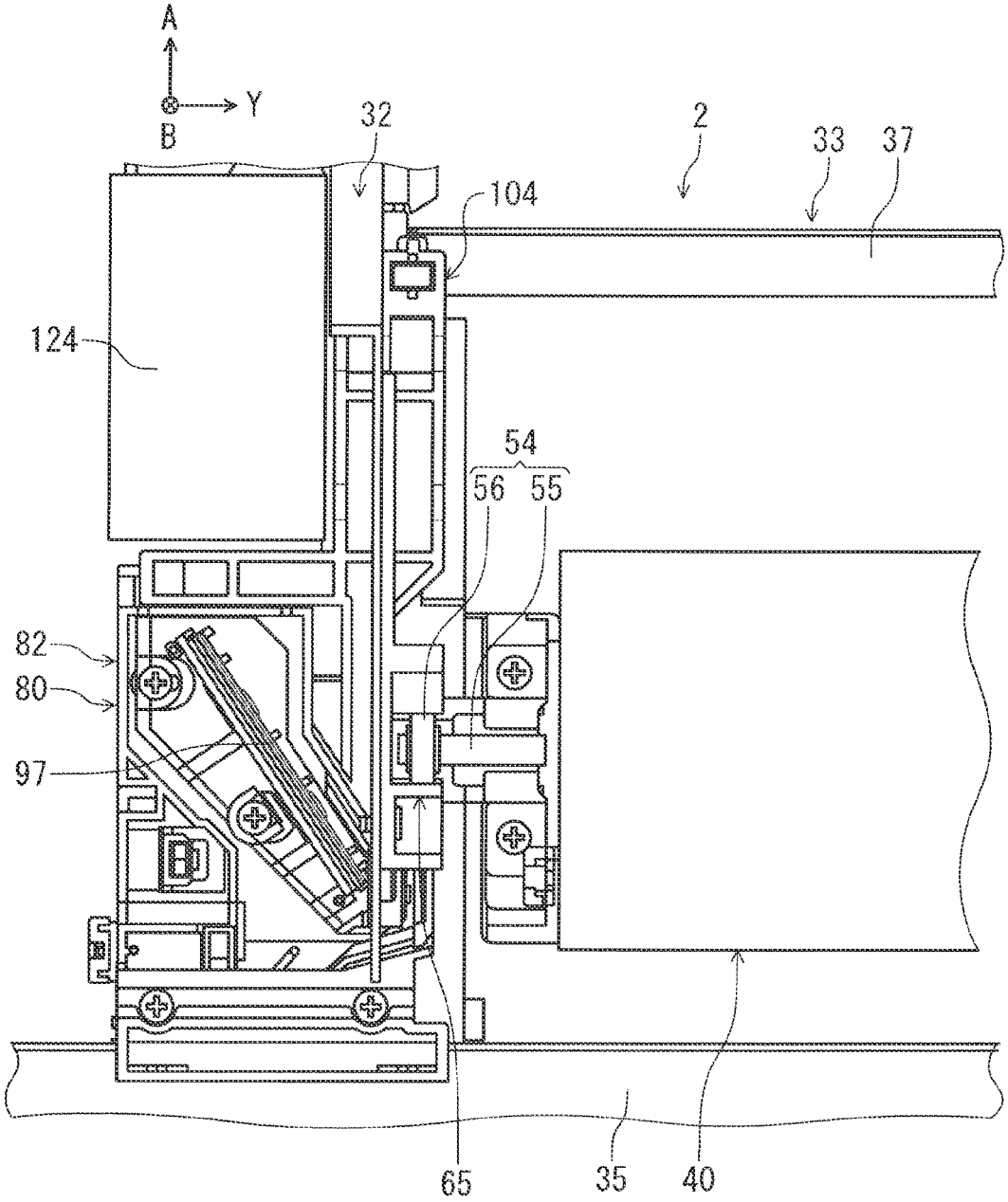
FIG. 8 is a plan view illustrating an arrangement state of the line head and the wiper unit of the printer according to the embodiment.

As illustrated in FIG. 8, a guide section 33 for guiding the wiper carriage 104 described later in the Y direction is provided in the housing 2. The guide section 33 includes, for example, a first guide rail 35 and a second guide rail 37 that are parallel to each other in the Y direction. The second guide rail 37 is arranged in the direction +A with respect to the first guide rail 35 when viewed in the direction B.

As illustrated in FIG. 9, the wiper carriage 104 is an example of the support section. The wiper carriage 104 is provided to be movable in the Y direction and supports the blade unit 82 in the direction B. Specifically, the wiper carriage 104 includes a first frame member 105 and a second frame member 122.

The first frame member 105 includes a mounting section 106, a first arm section 112, a first guided section 114, a second arm section 115, and a second guided section 116. The first guided section 114 and the second guided section 116 are referred to as a guided section 113 collectively. The guided section 113 is guided in the Y direction upon coming into contact with the guide section 33.

The blade unit 82 is mounted on the mounting section 106. The first permitting section 107 recessed in the −Y direction is formed in the +Y direction end of the mounting section 106. That is, the first permitting section 107 is formed in the wiper carriage 104.

The first permitting section 107 has an external shape obtained by removing a portion indicated by trapezoid FGHI from a quadrangle having sides extending in the direction A and sides extending in the Y direction when viewed in the direction B. The first permitting section 107 is a portion that permits passage of the protrusion 54 (FIG. 3) in the direction B in a state in which the wiper unit 80 is at the non-maintenance position. Specifically, the first permitting section 107 is formed by a longitudinal wall 108, an inclined wall 109, and a lateral wall 111.

Here, the second permitting section 92 and the first permitting section 107 are referred to as a permitting section 90 collectively. The permitting section 90 is formed in the wiper unit 80. The permitting section 90 is a portion that permits the protrusion 54 (FIG. 3) to move in the direction B in a state in which the wiper unit 80 is at the non-maintenance position.

The longitudinal wall 108 is a portion corresponding to short base FG of trapezoid FGHI and extends in the direction A in the A-B plane. The inclined wall 109 is a portion corresponding to leg FI of trapezoid FGHI and is inclined in the +Y direction toward the direction +A. The lateral wall 111 is a portion corresponding to side GH of trapezoid FGHI and extends in the Y direction.

Here, a portion of pentagon ABCDE and a portion of trapezoid FGHI overlap in the Y direction when viewed in the direction B. In other words, a portion of pentagon ABCDE and a portion of trapezoid FGHI have an overlap margin L1 [mm] in the Y direction. A region in which a portion of pentagon ABCDE and a portion of trapezoid FGHI overlap when viewed in the direction B is a region S. The guide rails 65 and 73 are located in the region S.

The first arm section 112 stands upright in the direction −B from the direction −A end of the mounting section 106. The first guided section 114 is formed in the direction −B end of the first arm section 112. A portion of the aforementioned timing belt is attached to the first guided section 114.

The second arm section 115 extends in the direction +A from the direction +A end of the mounting section 106. The second guided section 116 is formed in the direction +A end of the second arm section 115. A roller 119 in contact with the second guide rail 37 is rotatably provided in the second guided section 116.

When the second frame member 122 is attached to the first guided section 114, a portion of the first guide rail 35 is held between the second frame member 122 and the first guided section 114 in the Y direction.

In this manner, the wiper carriage 104 is movable in the Y direction in a state in which the blade unit 82 is mounted on the wiper carriage 104.

Note that, in the printer 1, for example, a substrate 124 (FIG. 8) is arranged to be located in the direction +A with respect to the mounting section 106 and in the −Y direction with respect to the second guided section 116.

The +Y direction end of the blade section 96, which is a portion of the blade section 96, and the permitting section 90 overlap in the Y direction when viewed in the direction B. In other words, a portion of the blade section 96 and the permitting section 90 have an overlap margin L2 [mm] in the Y direction.

The +Y direction end of the ink storage section 94, which is a portion of the ink storage section 94, and the permitting section 90 overlap in the Y direction when viewed in the direction B. In other words, a portion of the ink storage section 94 and the permitting section 90 have an overlap margin L3 [mm] in the Y direction.

Next, operation of the printer 1 will be described with reference to FIGS. 1 to 9. Note that description of individual drawing number will be omitted.

According to the printer 1, since the permitting section 90, which constitutes a portion of the wiper unit 80, permits the protrusion 54, which is a portion of the line head 40, to move in the direction B, the protrusion 54 and the wiper unit 80 are able to overlap in the Y direction. Accordingly, it is possible to suppress a size increase of the printer 1 in the Y direction compared with a configuration in which the protrusion 54 and the wiper unit 80 do not overlap in the Y direction.

According to the printer 1, a range in which the line head 40 is movable in the direction B is widened compared with a configuration in which movement of the line head 40 in the direction B is stopped before reaching the permitting section 90. Accordingly, it is possible to set a position at which the line head 40 performs printing on the medium M to be farther from the wiper unit 80, thus making it possible to prevent the transported medium M from interfering the wiper unit 80.

According to the printer 1, since the width of the wiper unit 80 in the Y direction is reduced compared with a configuration in which the blade section 96 and the permitting section 90 are arranged without overlapping in the Y direction, it is possible to suppress a size increase of the printer 1 in the Y direction.

According to the printer 1, it is not necessary to form the permitting section 90 in the region of the wiper unit 80, in which the ink K flows. That is, it is not necessary to reduce the region in which the ink K flows, thus making it possible to suppress a situation in which the ink K hardly flows.

According to the printer 1, a portion of a region in which the permitting section 90 is able to be formed is enlarged in the Y direction compared with a configuration in which the main blade 97 extends in a direction orthogonal to the Y direction when viewed in the direction B. Accordingly, an overlap margin of the line head 40 and the wiper unit 80 in the Y direction increases, thus making it possible to suppress a size increase of the printer 1 in the Y direction.

According to the printer 1, it is possible to reduce the width of the wiper unit 80 in the Y direction compared with a configuration in which the ink storage section 94 and the permitting section 90 do not overlap in the Y direction, thus making it possible to suppress a size increase of the printer 1 in the Y direction.

According to the printer 1, when the ink storage section 94 is located below the main blade 97, the ink K scraped by the main blade 97 flows to the ink storage section 94 due to the weight of the ink K, thus making it possible to easily collect the ink K in the ink storage section 94. Further, when the permitting section 90 is located in a vacant region above the main blade 97, a region of the wiper unit 80 around the main blade 97 is effectively used, thus making it possible to suppress a size increase of the wiper unit 80.

According to the printer 1, the second permitting section 92 is recessed toward the main blade 97 more than the first permitting section 107 compared with a configuration in which the second permitting section 92 and the first permitting section 107 have the same size, thus making it possible to reduce the volume and mass of the blade unit 82. As a result, the blade unit 82 is able to be easily removed, for example, to exchange the main blade 97 by removing the blade unit 82 from the wiper unit 80.

Although the printer 1 according to the embodiment of the disclosure basically has the above-described configuration, it is of course possible, for example, to partially change or omit a configuration without departing from the scope of the disclosure of the present application.

The printer 1 may have a configuration in which the entire blade section 96 and the permitting section 90 overlap in the Y direction when viewed in the direction B. Moreover, the maintenance section is not limited to one that scrapes the ink K from the ejection surface 42 and may be, for example, a capping unit that covers the ejection surface 42 and that receives the ink K that is tentatively ejected.

The permitting section 90 may be formed in the region S1.

The main blade 97 may extend in the direction A when viewed in the direction B. Moreover, the main blade 97 may divide the entire wiper unit 80 into two regions.

The printer 1 may have a configuration in which the entire ink storage section 94 and the permitting section 90 overlap in the Y direction.

The line head 40 is not limited to be configured to be raised/lowered in the direction B and may be configured to be raised/lowered in the Z direction. The wiper unit 80 may be arranged in a state of extending in the X direction.

The number of permitting sections 90 is not required to be two like the first permitting section 107 and the second permitting section 92 and may be one or three or more.

The line head 40 is not limited to one that passes through the first permitting section 107 in the direction B and may have a configuration in which, for example, the line head 40 is stopped after moving to a position adjacent to the second permitting section 92 in the Y direction and is located in the direction −B with respect to the mounting section 106. According to such a configuration, the second permitting section 92 and the main blade 97 overlap in the Y direction, thus making it possible to further reduce the width of the printer 1 in the Y direction.

The permitting section 90 may be a cut-out section obtained by cutting out a portion of a member.

The region S and the guide rails 65 and 73 may overlap when viewed in the direction B while the wiper unit 80 is at a position other than the non-maintenance position, which is a home position, for example, while the wiper unit 80 is at a position at which the ink K in the ink storage section 94 is discarded.

The wiper unit 80 may retreat in not the −Y direction but the +Y direction.

The maintenance section is not limited to the wiper unit 80 and may be, for example, a medium-width detecting unit that detects a width of the medium M by moving in the Y direction.

The protrusion 54 is not limited to a rotatable portion constituted by the shaft section 55 and the bearing 56 and may be a protruding section that protrudes from the line head 40 in the Y direction and that does not rotate.

What is claimed is:

1. A printing apparatus comprising:

a recording section that is configured to perform recording on a medium by ejecting a liquid from an ejection surface, the recording section configured to move in a first movement direction between a recording position where recording on the medium is performed and a retreat position where recording on the medium is not performed, the retreat position being different from the recording position, the first movement direction being a direction that is orthogonal to the ejection surface; and a maintenance section that is configured to move, in a second movement direction intersecting the first movement direction, between first position at which the maintenance section is configured to contact the ejection surface so as to perform a maintenance operation for the recording section and a second position away from the first position where the maintenance section does not contact the ejection surface, wherein at least one permitting section is formed in the maintenance section, the at least one permitting section permitting a portion of the recording section to move in the first movement direction in a state in which the maintenance section is at the second position.

2. The printing apparatus according to claim 1, wherein the permitting section is formed such that a portion of the recording section is configured to pass through the permitting section in the first movement direction.

3. The printing apparatus according to claim 1, wherein the maintenance section includes a scraping section that scrapes the liquid from the ejection surface in accordance with movement in the second movement direction, and when viewed in the first movement direction, at least a portion of the scraping section overlaps the permitting section in the second movement direction.

4. The printing apparatus according to claim 3, wherein the scraping section is a blade that divides at least a portion of the maintenance section into a first region and a second region when viewed in the first movement direction, the first region is a region on a first side of the blade in which the liquid scraped by the blade flows and the second region is a region on second side of the blade that is opposite to the first region in which the liquid flows, and the permitting section is formed in the second region.

5. The printing apparatus according to claim 4, wherein the blade extends in an intersecting direction, which intersects the second movement direction, when viewed in the first movement direction.

6. The printing apparatus according to claim 4, wherein the maintenance section includes a liquid storage section that stores the liquid scraped by the blade, and when viewed in the first movement direction, at least a portion of the liquid storage section overlaps the permitting section in the second movement direction.

7. The printing apparatus according to claim 6, wherein the maintenance section is arranged in a state of being inclined in a direction orthogonal to the first movement direction when viewed in the second movement direction, the liquid storage section is located below the blade in the vertical direction, and the permitting section is located above the blade in the vertical direction.

8. The printing apparatus according to claim 4, wherein the maintenance section includes a blade holding section that holds the blade and a support section that is configured to move in the second movement direction and supports the blade holding section in the first movement direction, and the permitting section includes a first permitting section formed in the support section and a second permitting section that is formed in the blade holding section and recessed in the second movement direction toward the blade more than the first permitting section.

9. A printing apparatus comprising:

a recording section that is configured to perform recording on a medium by ejecting a liquid from an ejection surface, the recording section configured to move between a recording position where recording on the medium is performed and a retreat position where recording on the medium is not performed, the retreat position being different from the recording position; and a maintenance section that is configured to move, in a second movement direction intersecting a first movement direction, the first movement direction being a movement direction of the recording section, between a maintenance position at which the maintenance section is configured to perform a maintenance operation for the recording section and a non-maintenance position where the maintenance operation for the recording section is not performed, the non-maintenance position being different from the maintenance position, wherein at least one permitting section is formed in the maintenance section, the at least one permitting section permitting a portion of the recording section to move in the first movement direction in a state in which the maintenance section is at the non-maintenance position.

10. The printing apparatus according to claim 9, wherein the permitting section is formed such that a portion of the recording section is configured to pass through the permitting section in the first movement direction.

11. The printing apparatus according to claim 9, wherein the maintenance section includes a scraping section that scrapes the liquid from the ejection surface in accordance with movement in the second movement direction, and when viewed in the first movement direction, at least a portion of the scraping section overlaps the permitting section in the second movement direction.

12. The printing apparatus according to claim 11, wherein the scraping section is a blade that divides at least a portion of the maintenance section into a first region and a second region when viewed in the first movement direction, the first region is a region on a first side of the blade in which the liquid scraped by the blade flows and the second region is a region on second side of the blade that is opposite to the first region in which the liquid flows, and the permitting section is formed in the second region.

13. The printing apparatus according to claim 12, wherein the blade extends in an intersecting direction, which intersects the second movement direction, when viewed in the first movement direction.

14. The printing apparatus according to claim 12, wherein the maintenance section includes a liquid storage section that stores the liquid scraped by the blade, and when viewed in the first movement direction, at least a portion of the liquid storage section overlaps the permitting section in the second movement direction.

15. The printing apparatus according to claim 14, wherein the maintenance section is arranged in a state of being inclined in a direction orthogonal to the first movement direction when viewed in the second movement direction, the liquid storage section is located below the blade in the vertical direction, and the permitting section is located above the blade in the vertical direction.

16. The printing apparatus according to claim 12, wherein the maintenance section includes a blade holding section that holds the blade and a support section that is configured to move in the second movement direction and supports the blade holding section in the first movement direction, and the permitting section includes a first permitting section formed in the support section and a second permitting section that is formed in the blade holding section and recessed in the second movement direction toward the blade more than the first permitting section.

17. A printing apparatus comprising:

a recording section that is configured to perform recording on a medium by ejecting a liquid from an ejection surface, the recording section configured to move between a recording position where recording on the medium is performed and a retreat position where recording on the medium is not performed, and the retreat position being different from the recording position; and a maintenance section that is configured to move, in a second movement direction intersecting a first movement direction, the first movement direction being a movement direction of the recording section, between a maintenance position at which the maintenance section is configured to perform a maintenance operation for the recording section and a non-maintenance position where the maintenance operation for the recording section is not performed, and the non-maintenance position being different from the maintenance position, wherein the maintenance section at the maintenance position faces the recording section, the maintenance section at the non-maintenance position does not face the recording section, and at least one permitting section is formed in the maintenance section, the at least one permitting section permitting a portion of the recording section to move in the first movement direction in a state in which the maintenance section is at the non-maintenance position.

* * * * *